US007866803B2

(12) United States Patent
Gonzales

(10) Patent No.: US 7,866,803 B2
(45) Date of Patent: Jan. 11, 2011

(54) REPLACEABLE PRINTER COMPONENT WITH ELECTRONIC TAG

(75) Inventor: Curt Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 102 days.

(21) Appl. No.: 12/239,540

(22) Filed: Sep. 26, 2008

(65) Prior Publication Data

US 2009/0274472 A1 Nov. 5, 2009

Related U.S. Application Data

(60) Provisional application No. 61/049,481, filed on May 1, 2008.

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS

| | | | | |
|---|---|---|---|---|
| 5,788,388 | A | 8/1998 | Cowger | |
| 6,039,430 | A | 3/2000 | Helterline | |
| 6,126,265 | A | 10/2000 | Childers | |
| 6,406,120 | B2 * | 6/2002 | Pauschinger | 347/19 |
| 6,459,860 | B1 | 10/2002 | Childers | |
| 6,585,345 | B2 * | 7/2003 | Kosugi | 347/19 |
| 6,723,917 | B1 * | 4/2004 | Wang | 174/383 |
| 6,817,693 | B2 | 11/2004 | Phillips | |
| 7,048,366 | B2 * | 5/2006 | Alexia et al. | 347/87 |

* cited by examiner

*Primary Examiner*—Omar Rojas

(57) ABSTRACT

A replaceable printer component including an electronic tag and an angled protective ramp. The electronic tag is attached to a surface of the replaceable printer component. The angled protective ramp extends from the surface of the replaceable printer component adjacent the electronic tag. The angled protective ramp has a height that is greater than a height of the electronic tag.

16 Claims, 5 Drawing Sheets

REPLACEABLE PRINTER COMPONENT WITH ELECTRONIC TAG

CROSS-REFERENCE TO RELATED APPLICATIONS

This application claims the benefit of U.S. Provisional patent application Ser. No. 61/049,481, filed on 1 May 2008, which is hereby incorporated by reference in its entirety.

BACKGROUND

There are many types of printing systems that facilitate generating text or images on paper. One common type of printing system is an inkjet printing system, which may include a printhead and an ink supply that supplies liquid ink to the printhead.

The printhead ejects drops of the ink through a plurality of nozzles or orifices and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

The printhead and the ink supply may be housed together in a removable printer cartridge that may be replaced when the ink is depleted. In some configurations, the printer cartridge includes an electronic tag that may be used for a variety of tasks such as enabling certain features of the printing system or providing access to internet sites.

The electronic tag is often attached to the surface of the printer cartridge. This placement of the electronic tag makes it susceptible to damage such as through dropping prior to insertion of the printer cartridge into the printer or through contact with other components of the printer while the printer cartridge is being inserted into the printer.

For these and other reasons, a need exists for the present invention.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
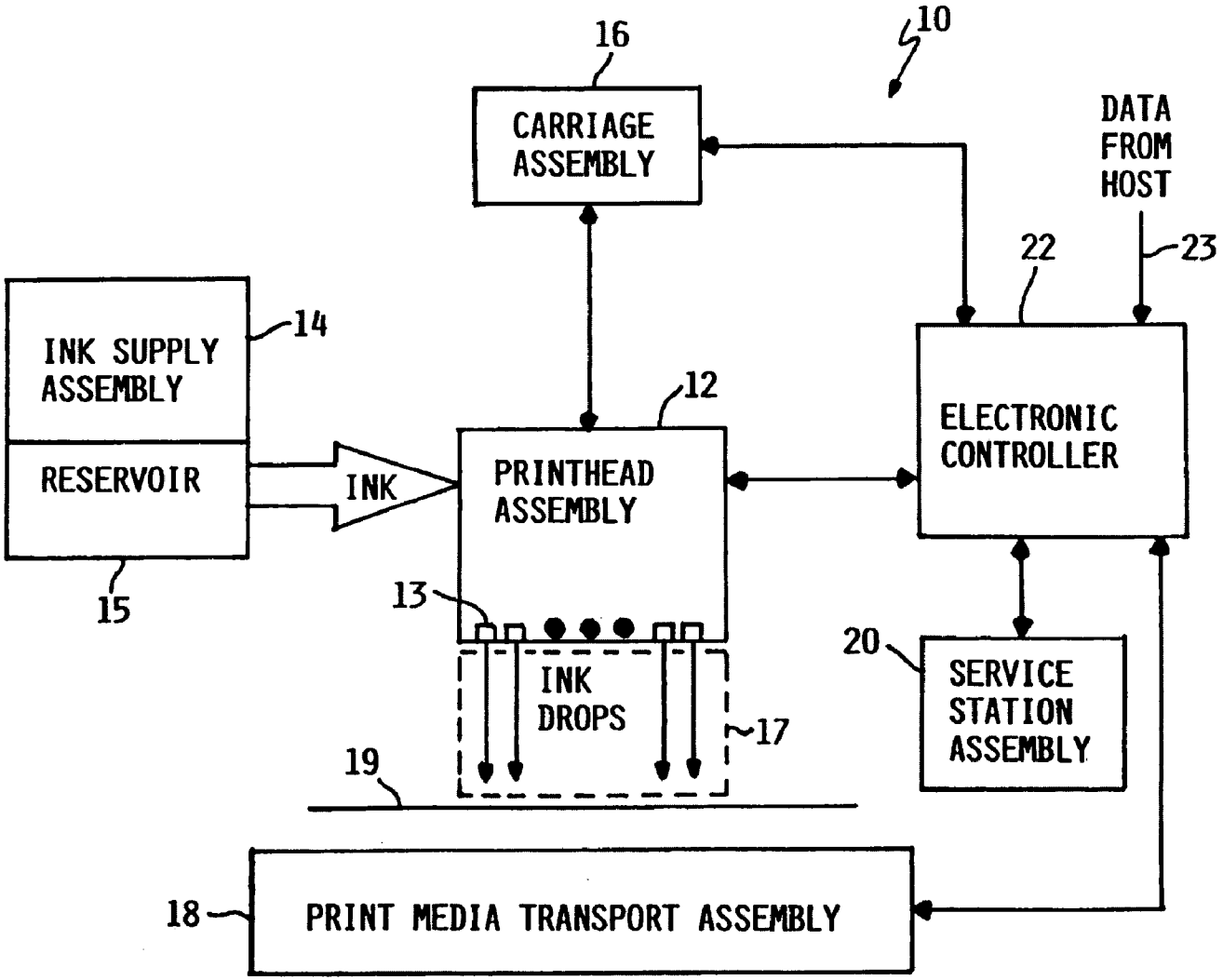
FIG. 1 is a block diagram illustrating one embodiment of a printing system that incorporates the invention.

FIG. 1 illustrates one embodiment of an inkjet printing system 10 according to embodiments of the present invention. Inkjet printing system 10 includes an inkjet printhead assembly 12, an ink supply assembly 14, a printer carriage assembly 16, a print media transport assembly 18, a service station assembly 20, and an electronic controller 22.

The inkjet printhead assembly 12 includes one or more printheads that eject drops of ink through a plurality of nozzles or orifices 13 and toward an embodiment of media, such as print medium 19, so as to print onto the print medium 19. The print medium 19 is any type of suitable sheet material, such as paper, card stock, transparencies, Mylar, cloth, and the like. Typically, the orifices 13 are arranged in one or more columns or arrays such that properly sequenced ejection of ink from the orifices 13 causes characters, symbols, and/or other graphics or images to be printed upon the print medium 19 as the inkjet printhead assembly 12 and the print medium 19 are moved relative to each other.

The ink supply assembly 14 supplies ink to the inkjet printhead assembly 12 and, in one embodiment, includes a reservoir 15 for storing ink. As such, ink flows from the reservoir 15 to the inkjet printhead assembly 12. In one embodiment, the inkjet printhead assembly 12 and the ink supply assembly 14 are housed together in an inkjet printer cartridge or pen. In another embodiment, the ink supply assembly 14 is separate from the inkjet printhead assembly 12 and supplies ink to the inkjet printhead assembly 12 through an interface connection, such as a supply tube. In either embodiment, the ink supply assembly 14 and/or the reservoir 15 of the ink supply assembly 14 may be removed, replaced, and/or refilled.

The printer carriage assembly 16 positions the inkjet printhead assembly 12 relative to the print media transport assembly 18 and the print media transport assembly 18 positions the print medium 19 relative to the inkjet printhead assembly 12. Thus, a print zone 17 is defined adjacent to the orifices 13 in an area between the inkjet printhead assembly 12 and the print medium 19.

In one embodiment, the inkjet printhead assembly 12 is a scanning type printhead assembly such that the printer carriage assembly 16 moves the inkjet printhead assembly 12 relative to the print media transport assembly 18 and the print medium 19 during printing on the print medium 19. In another embodiment, the inkjet printhead assembly 12 is a non-scanning type printhead assembly such that the printer carriage assembly 16 fixes the inkjet printhead assembly 12 at a prescribed position relative to the print media transport assembly 18 during printing on the print medium 19 as the print media transport assembly 18 advances the print medium 19 past the prescribed position.

To maintain a functionality of the inkjet printhead assembly 12 and, more specifically, the orifices 13 of the inkjet printhead assembly 12, the service station assembly 20 provides for spitting, Wiping, capping, and/or priming of the inkjet print assembly 12. In one embodiment, the service station assembly 20 includes a rubber blade or wiper which is periodically passed over the inkjet printhead assembly 12 to wipe and clean orifices 13 of excess ink.

In one embodiment, service station assembly 20 includes a cap which covers the inkjet printhead assembly 12 to protect the orifices 13 from drying out during periods of non-use. In one embodiment, the service station assembly 20 includes a spittoon into which the inkjet printhead assembly 12 ejects ink to insure that the reservoir 15 maintains an appropriate level of pressure and fluidity and that the orifices 13 do not clog or weep.

The electronic controller 22 communicates with the inkjet printhead assembly 12, the printer carriage assembly 16, the print media transport assembly 18, and the service station assembly 20. The electronic controller 22 receives data 23 from a host system, such as a computer, and includes memory for temporarily storing the data 23. Typically, the data 23 is sent to the inkjet printing system 10 along an electronic, infrared, optical or other information transfer path. The data 23 represents, for example, a document and/or file to be printed. As such, the data 23 forms a print job for the inkjet printing system 10 and includes one or more print job commands and/or command parameters.

In one embodiment, the electronic controller 22 provides control of the inkjet printhead assembly 12 including timing control for ejection of ink drops from the orifices 13. As such, the electronic controller 22 defines a pattern of ejected ink drops which form characters, symbols, and/or other graphics or images on the print medium 19. Timing control and, therefore, the pattern of ejected ink drops, is determined by the print job commands and/or command parameters.

Figure 2:
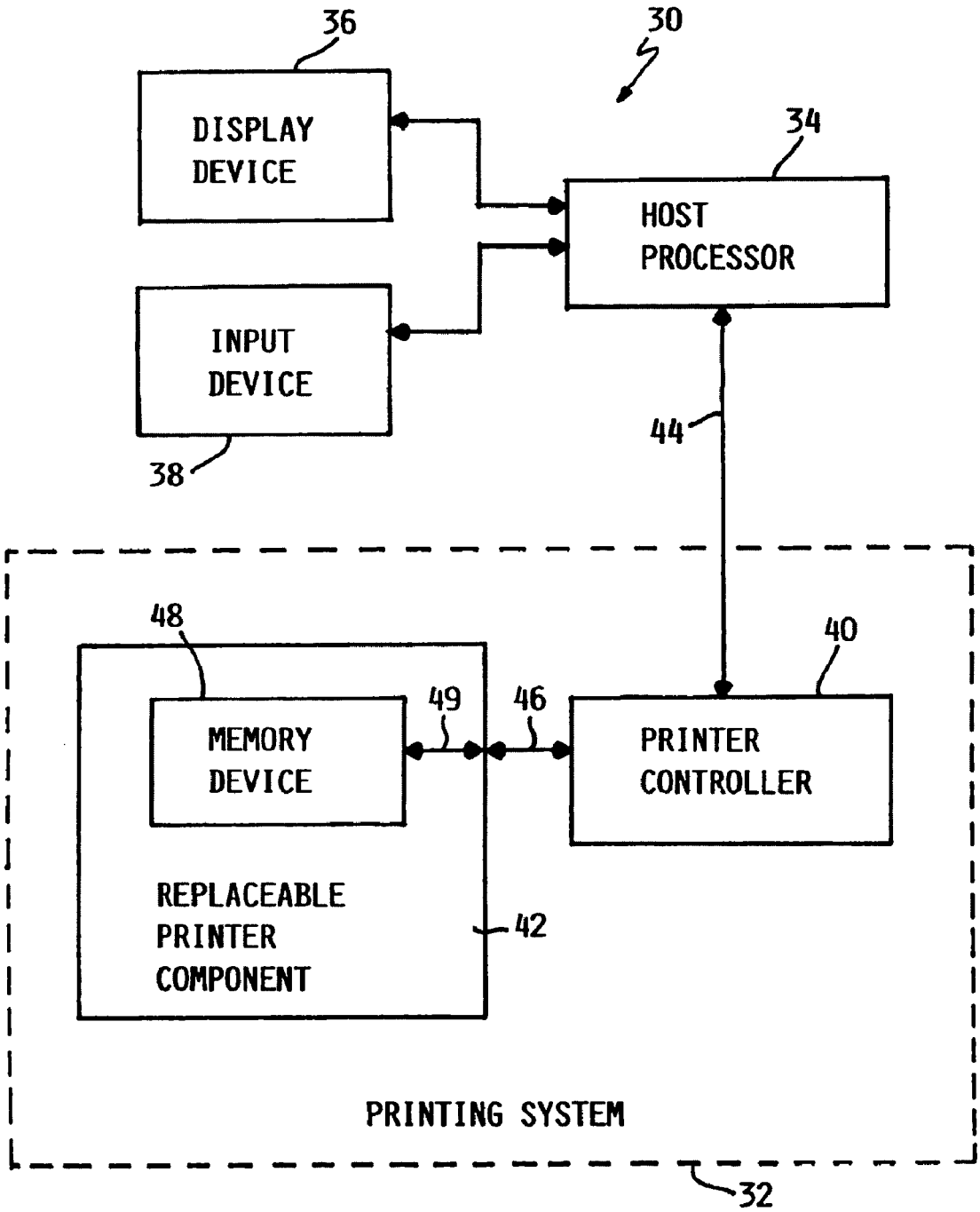
FIG. 2 is a block diagram illustrating one embodiment of a print arrangement in which the invention may be incorporated.

A schematic illustration of one configuration of the operation of a printing arrangement 30 is illustrated in FIG. 2. The printing arrangement 30 may include a printing system 32, a host processor 34, a display device 36 and an input device 38. The printing system 32 facilitates printing of graphical and/or textual images on a print medium, such as paper. The printing system 32 may include, for example, an inkjet printer, a laser printer, etc. In one embodiment, the printing system 32 includes the inkjet printing system 10 of FIG. 1.

The host processor 34 communicates with the printing system 32 and provides data and/or control signals to the printing system 32. The host processor 34 may be or may be included in a variety of information sources such as a computer, appliance or other device such as a personal digital assistant (PDA), digital camera, cellular phone, etc.

The display device 36 communicates with the host processor 34 and displays information communicated from the host processor 34. The display device 36 may include a screen, monitor or other device that presents information in visual form.

The input device 38 communicates with the host processor 34 and enables a user of the printing arrangement 32 to interact with the display device 36 and the host processor 34. The input device 38 may include a keyboard, touch screen, mouse or other screen-positioning device for input and/or selection of commands and/or functions for the printing arrangement 30.

In one configuration, the printing system 32 includes a printer controller 40 and a replaceable printer component 42. The printer controller 40 controls operation of the printing system 32 and, as such, receives data and/or control signals from the host processor 34. In one embodiment, where the printing system 32 includes the inkjet printing system 10 of FIG. 1, the printer controller 40 includes the electronic controller 22 of FIG. 1. The printer controller 40 communicates with the host processor 34 via a communication link 44. The communication link 44 may include, for example, an electrical, optical, infrared or other information transfer path between the printer controller and the host processor 34.

The replaceable printer component 42 may include a component of the printing system 32 that is removably mounted in the printing system 32. In one embodiment, the replaceable printer component 42 includes a consumable component that is disposed of and replaced at an end of a useful life thereof.

An example of such a consumable component includes an ink container (such as the ink supply assembly 14 and/or the reservoir 15 of FIG. 1) or a toner cartridge that contains a supply of marking material for the printing system 32 and is depleted during a useful life of the ink container or the toner cartridge. As such, the ink container or the toner cartridge is disposed of and replaced at an end of a useful life thereof.

In addition, the replaceable printer component 42 may also include a printing component that is readily replaced in the printing system 32. Examples of such a printing component include a printhead that selectively deposits ink on a print medium in response to control signals from the printer controller 40 or a printer cartridge that includes a printhead and an ink supply.

Thus, the replaceable printer component 42 may include an ink container, a printhead or a printer cartridge if, for example, the printing system 32 includes an inkjet printer. In addition, the replaceable printer component 42 may include a toner cartridge if, for example, the printing system 32 includes a laser printer.

The printer control 40 and the replaceable printer component 42 communicate with each other via a communication link 46. The communication link 46 facilitates information transfer between the printer controller 40 and the replaceable printer component 42 when the replaceable printer component 42 is installed in the printing system 32. The communication link 46 may include, for example, an electrical, optical, infrared or other information transfer path between the replaceable printer component 42 and the printer controller 40.

In one embodiment, the replaceable printer component 42 includes a memory device or electronic tag 48 that stores information for the replaceable printer component 42 and/or the printing system 32. More specifically, the electronic tag 48 can store, for example, information that is specific to the replaceable printer component 42 and/or information that is applicable to the printing system 32.

In addition, the electronic tag 48 can have information to be used by the printing system 32 stored therein or can record information for the printing system 32. Furthermore, information that may be stored in the electronic tag 48 includes operational and/or non-operational parameters as described, for example, in U.S. Pat. No. 6,039,430 entitled. "Method and Apparatus for Storing and Retrieving Information on a Replaceable Printing Component," which is assigned to the assignee of the present invention and incorporated herein by reference.

In one embodiment, the replaceable printer component 42 includes a communication link 49 that electrically couples or communicates the electronic tag 48 with the communication link 46 and, therefore, the printer controller 40 when the replaceable printer component 42 is installed in the printing system 32.

As such, when the replaceable printer component 42 is installed in the printing system 32, the electronic tag 48 communicates with the printer controller 40 via the communication links 46 and 49. Thus, the communication links 46 and 49 include, for example, electrical couplings or connections such as electrical contacts or pins that mate with the corresponding electrical nodes or receptacles, respectively.

In one embodiment, the electronic tag 48 has information stored therein. Since the electronic tag 48 and, therefore, the information are included in the replaceable printer component 42, the information is communicated to the printer controller 40 and the host processor 34 when the replaceable printer component 42 is installed in the printing system 32.

The information is communicated to the printer controller 40 via communication links 46 and 49 and communicated to the host processor 34 from the printer controller 40 via the communication link 44. In one embodiment, the printer controller 40 reads the information when from the electronic tag 48 when the replaceable printer component 42 is installed in the printing system 32.

While it is possible to integrally fabricate the electronic tag 48 and the replaceable printer component 42, the electronic tag 48 and the replaceable printer component 42 are often fabricated separately and then attached together.

It is also possible to fabricate the electronic tag 48 so that the electronic tag 48 is in communication with components inside of the replaceable printer component 42. Such a configuration would enable monitoring the level of a depletable component in the replaceable printer component 42 such as ink or toner. This configuration would also enable monitoring of the operation of the replaceable printer component 42 such that the user may be notified when an error occurs.

While it is desirable to mount the electronic tag 48 on a portion replaceable printer component 42 that affords the highest amount of protection to the electronic tag 48, the electronic tag 48 should be positioned at a location on the replaceable printer component 42 that enables the electronic tag 48 to communicate with other components of the printing system 32. In printing systems 32 having a plurality of replaceable printer components 42, the areas in which the electronic tag 48 can be placed may be limited.

Figure 3:
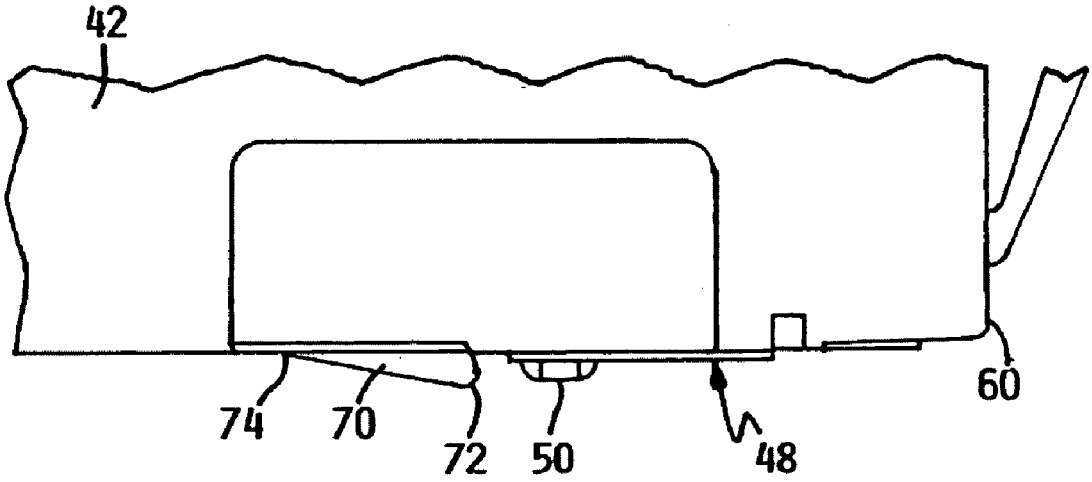
FIG. 3 is a side view of a printer cartridge incorporating a protective ramp according to an embodiment of the invention.
Figure 4:
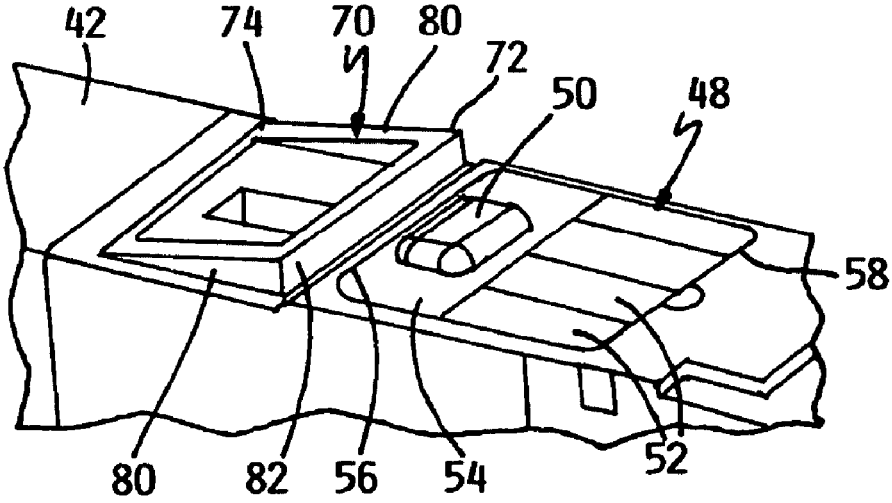
FIG. 4 is a lower perspective view of the printer cartridge of FIG. 3.

In one configuration of the replaceable printer component 42, the electronic tag 48 is attached to a lower surface of the replaceable printer component 42, as illustrated in FIGS. 3-4. It is possible to utilize the concepts of the invention in conjunction with the placement of the electronic tag 48 in other locations on the lower surface of the replaceable printer component 42 as well as placement of the electronic tag 48 on other sides or surfaces of the replaceable printer component 42.

It is possible to utilize a variety of techniques for attaching the electronic tag 48 to the replaceable printer component 42. One such technique is using a pressure sensitive adhesive.

In one commercial manufacturing technique, the electronic tag 48 is attached to the replaceable printer component 42 using robotic technology, as the robotic technology enables the electronic tag 48 to be attached to the replaceable printer component 42 at a high rate such as more than 50 units per minute.

While the robotic technology is able to place the electronic tag 48 in a relatively accurate position on the replaceable printer component 42, there may be some deviations in the placement of the electronic tag 48 on the replaceable printer component 42. In some operations, the deviations in the placement of the electronic tag 48 on the replaceable printer component 42 may be ±0.5 millimeters in width and length.

In one embodiment, the electronic tag 48 may include a memory chip 50 and a plurality of electrical contacts 52 that are both mounted on a substrate 54, as illustrated in FIGS. 3-4. In one embodiment, the memory chip 50 may be positioned proximate a first end 56 of the substrate 54.

The memory chip 50 may take a variety of sizes and storage capacities depending on the intended use of the replaceable printer component 42. As opposed to merely storing information, it is possible for the electronic tag 48 to include additional capabilities such as computational and/or analytical.

To protect the memory chip 50 from damage caused by contact from external objects, the memory chip 50 may be at least partially covered by a polymeric material. A person of ordinary skill in the art will appreciate that it is possible to use a variety of polymeric material to at least partially cover the memory chip 50. One suitable polymeric material is epoxy.

In one embodiment, the electrical contacts 52 are operably attached to the memory chip 50 proximate a second end 58 of the substrate 54. The electrical contacts 52 thereby enable the memory chip 50 to communicate with the other components of the printing system 32. As such, the electrical contacts 52 contact the electrical contacts (not shown) on the component of the printing system 32 to which the replaceable printer component 42 interacts when the replaceable printer component 42 is mounted in the printing system 32. In one configuration, there may be four electrical contacts 52.

Figure 6:
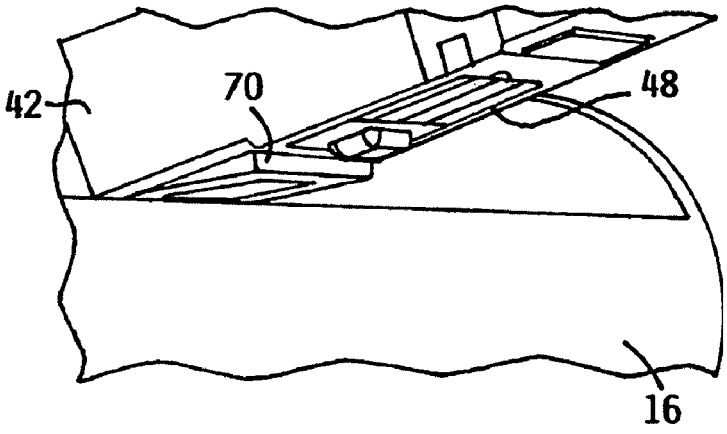
FIG. 6 is an enlarged perspective view of the protective ramp adjacent to a front wall of the printer carriage.

In one embodiment, the electronic tag 48 may be attached to the replaceable printer component 42 proximate a back edge 60 thereof, as illustrated in FIGS. 3 and 6. As used herein, the term back edge 60 refers to an edge of the replaceable printer component 42 that is opposite a front edge 62 of the replaceable printer component 42 that is inserted into the printer carriage assembly 16 first.

In one exemplary embodiment, an overall height of the electronic tag 48, including the adhesive that is utilized to attach the electronic tag 48 to the replaceable printer component 42, may be between about 0.85 and 0.95 millimeters.

In one embodiment illustrated in FIGS. 3 and 4, a protective ramp 70 extends from a surface of the replaceable printer component 42 proximate the first end 56 of the substrate 54 so that the protective ramp 70 does not extend over the substrate 54 and the associated electronic tag 48. In one exemplary embodiment, in view of the tolerances associated with placing the electronic tag 48 on the replaceable printer component 42 using robotic technology, a lateral spacing of about 1 millimeter may be provided between the protective ramp 70 and the electronic tag 48.

In one embodiment, the width of the protective ramp 70 is greater than a width of the memory chip 50. In one embodiment, the protective ramp 70 may extend substantially across a width of the replaceable printer component 42. Forming the protective ramp 70 with the preceding configuration enables the protective ramp 70 to protect the electronic tag 48, including the memory chip 50.

The protective ramp 70 includes a first end 72 and a second end 74, and in one embodiment, tapers from a maximum height proximate the first end 72 to a minimal height proximate the second end 74. In one embodiment, the first end 72 of the protective ramp 70 is oriented towards the back edge 60 of the replaceable printer component 42. In one embodiment, the second end 74 is oriented towards the front edge 62 of the replaceable printer component 42.

While it is possible for the protective ramp 70 to be a substantially solid-filled ramp, the protective ramp 70 may be configured with a pair of side walls 80 that are positioned on opposite ends of an end wall 82. This configuration enables other components of the replaceable printer component 42 to be positioned at least partially within the protective ramp 70.

In one exemplary embodiment, the maximum height of the protective ramp 70 may be about 1.25 millimeters such that the protective ramp 70 is taller than the electronic tag 48. In other configurations, the protective ramp 70 may have a maximum height of about 2 millimeters. This configuration helps minimize the potential of the electronic tag 48 being contacted if the replaceable printer component 42 is dropped at an angle.

A length of the protective ramp 70 may be determined by the available space on the replaceable printer component 42 that is adjacent to the electronic tag 48. In one configuration, the protective ramp 70 has a length of between about 5 and 10 millimeters. In another configuration, the protective ramp 70 has a length of between about 7 and 8 millimeters.

Forming the protective ramp 70 with the preceding dimensions causes the protective ramp 70 to be oriented at an angle of between about 5 and 15 degrees with respect to the surface of the replaceable printer component 42.

Figure 5:
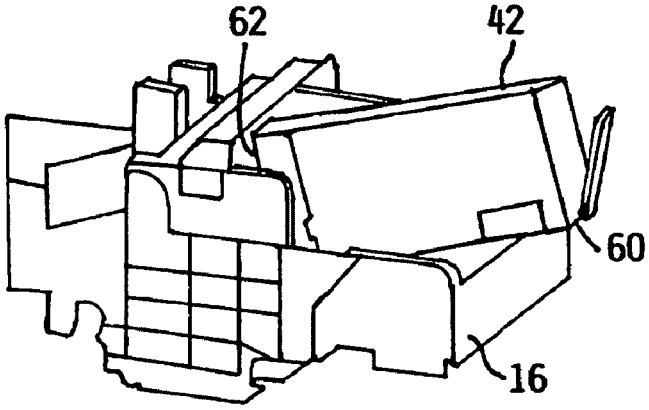
FIG. 5 is a perspective view of the printer cartridge of FIG. 3 being inserted into one embodiment of a printer carriage of a printer.
Figure 7:
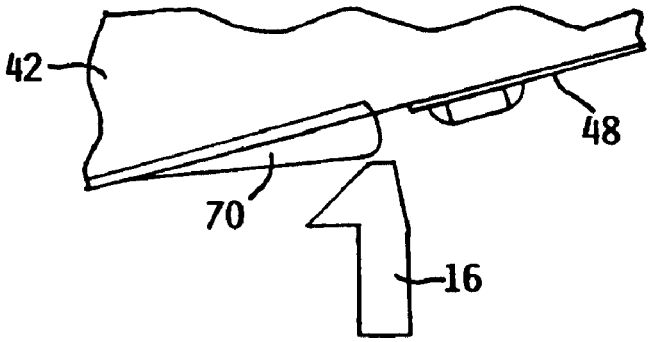
FIG. 7 is a side view of the protective ramp adjacent the front wall of the printer carriage.

In one embodiment, the replaceable printer component 42 is oriented so that the front edge 62 is inserted into the printer carriage assembly 16 first. When the replaceable printer component 42 is being placed into the printer carriage assembly 16, it is possible for the surface of the replaceable printer component 42 to slide along a surface of the printer carriage assembly 16, as illustrated in FIGS. 5-7.

During this process, the protective ramp 70 contacts the surface of the printer carriage assembly 16, which urges the replaceable printer component 42 upwardly as the replaceable printer component 42 continues to be inserted into the printer carriage assembly 16. The protective ramp 70 thereby reduces the potential of the surface of the printer carriage assembly 16 from contacting the electronic tag 48.

Figure 8:
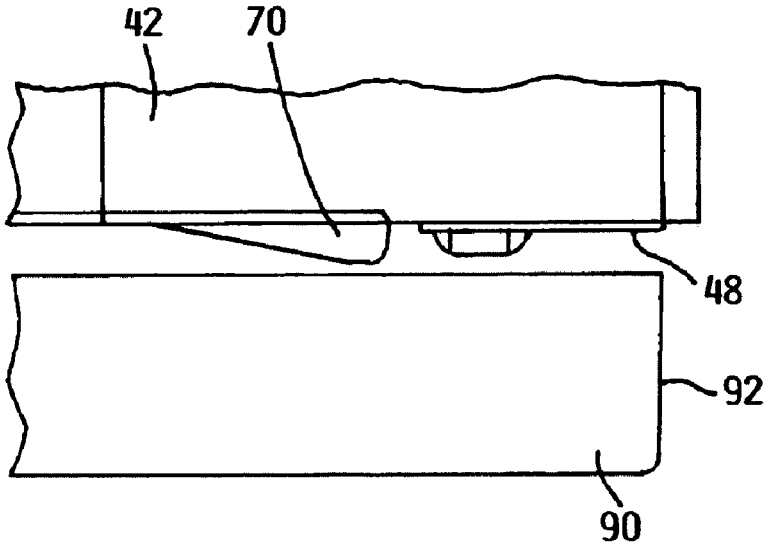
FIG. 8 is a side view of the printer cartridge with one embodiment of a protective cap extending over a lower surface of the printer cartridge.

The protective ramp 70 also protects the electronic tag 48 from contact when a protective cap 90 is placed over the lower surface of the replaceable printer component 42, as illustrated in FIG. 8. The protective cap 90 may be used, for example, during packaging or shipping of the replaceable printer component 42.

In one configuration, the protective cap 90 is attached to the replaceable printer component 42 proximate the front edge of the replaceable printer component 42 such that a back edge 92 of the protective cap 90 is supported by the protective ramp 70 to maintain a spacing between the protective cap 90 and the electronic tag 48.

Figure 9:
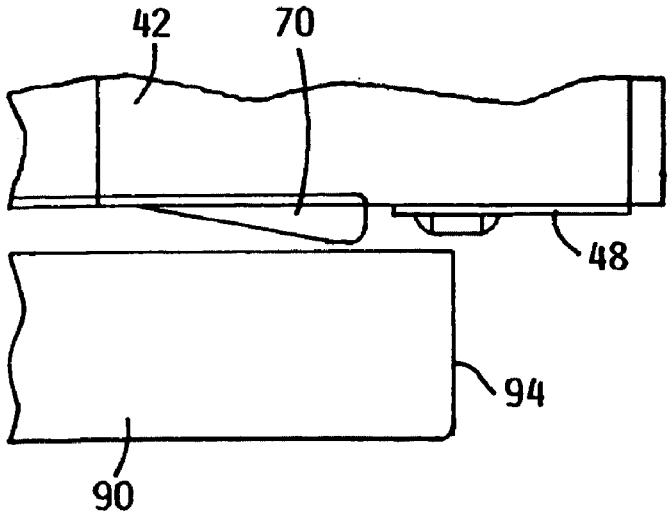
FIG. 9 is a side view of the printer cartridge with another embodiment of a protective cap extending over a lower surface of the printer cartridge.

In another configuration, the protective cap 90 extends only partially over the electronic tag 48, as illustrated in FIG. 9. The protective ramp 70 still provides protection for the electronic tag 48 by maintaining the protective cap 90 in a spaced-apart relationship with respect to the electronic tag 48.

Even though a portion, of the electronic tag 48 may be exposed, the protective cap 90 provides protection to the electronic tag 48, such as when the replaceable printer component 42 is dropped, as a shorter portion of the protective cap 90 is cantilevered beyond the protective ramp 70. As such, the cantilevered portion 94 is less likely to be deflected from contact such that the protective cap 90 does not contact the electronic tag 48.

In addition to protecting the electronic tag 48 from being damaged by contact with external objects, the protective ramp 70 also reduces the potential of the electronic tag 48 being dislodged from the replaceable printer component 42 when an external object strikes the electronic tag 48.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A replaceable printer component, comprising:

an electronic tag attached to a surface of the replaceable printer component;

an angled protective ramp extending from the surface of the replaceable printer component adjacent the electronic tag, wherein the angled protective ramp has a height that is greater than a height of the electronic tag; and a protective cap removably attached to the replaceable printer component, wherein the angled protective ramp supports the protective cap a spaced-apart distance from the electronic tag and wherein a portion of the protective cap extends beyond the angled protective ramp to cover a portion of the electronic tag.

2. The replaceable printer component of claim 1, wherein a surface of the angled protective ramp is oriented at an angle of between about 5 degrees and about 15 degrees with respect to the surface of the replaceable printer component.

3. The replaceable printer component of claim 1, wherein the angled protective ramp is defined by a pair of side walls and an end wall that extends between the side walls.

4. The replaceable printer component of claim 1, wherein the electronic tag comprises a memory chip and a plurality of electrical contacts that are both mounted on a substrate, and wherein the angled protective ramp has a width that is greater than a width of the memory chip.

5. The replaceable printer component of claim 1, wherein the replaceable printer component comprises one of an ink container, a printhead, a printer cartridge including an ink supply and a printhead, and a toner cartridge.

6. A printing system, comprising:

a printer carriage;

a replaceable printer component that is mountable in the printer carriage, wherein an electronic tag is attached to a surface of the replaceable printer component, wherein an angled protective ramp extends from the surface of the replaceable printer component adjacent the electronic tag, and wherein the angled protective ramp has a height that is greater than a height of the electronic tag; and a protective cap removably attached to the replaceable printer component, wherein the angled protective ramp supports the protective cap a spaced-apart distance from the electronic tag, and wherein a portion of the protective cap extends beyond the angled protective ramp to cover a portion of the electronic tag.

7. The printing system of claim 6, wherein a surface of the angled protective ramp is oriented at an angle of between about 5 degrees and about 15 degrees with respect to the surface of the replaceable printer component.

8. The printing system of claim 6, wherein the angled protective ramp is defined by a pair of side walls and an end wall that extends between the side walls.

9. The printing system of claim 6, wherein the electronic tag comprises a memory chip and a plurality of electrical contacts that are both mounted on a substrate, and wherein the angled protective ramp has a width that is greater than a width of the memory chip.

10. The printing system of claim 6, wherein the replaceable printer component comprises one of an ink container, a printhead, a printer cartridge including an ink supply and a printhead, and a toner cartridge.

11. A method of protecting an electronic tag on a replaceable printer component, wherein the method comprises:

providing an angled protective ramp on a surface of the replaceable printer component; and attaching the electronic tag to the surface of the replaceable printer component adjacent the angled protective ramp, wherein the angled protective ramp has a height that is greater than a height of the electronic tag;

inserting the replaceable printer component in a printer carriage, wherein the replaceable printer component has a first end and a second end that is oriented opposite the first end, wherein a height of the angled protective ramp is greater proximate the second end than proximate the first end, and wherein the first end is inserted into the printer carriage first; and wherein the angled protective ramp contacts the printer carriage as the replaceable printer component is being inserted into the printer carriage.

12. The method of claim 11, wherein a surface of the angled protective ramp is oriented at an angle of between about 5 degrees and about 15 degrees with respect to the surface of the replaceable printer component.

13. The method of claim 11, wherein the angled protective ramp is defined by a pair of side walls and an end wall that extends between the side walls.

14. The method of claim 11, wherein the electronic tag comprises a memory chip and a plurality of electrical contacts that are both mounted on a substrate, and wherein the angled protective ramp has a width that is greater than a width of the memory chip.

15. A method of protecting an electronic tag on a replaceable printer component, wherein the method comprises:

providing an angled protective ramp on a surface of the replaceable printer component;

attaching the electronic tag to the surface of the replaceable printer component adjacent the angled protective ramp, wherein the angled protective ramp has a height that is greater than a height of the electronic tag; and covering at least a portion of the electronic tag with a protective cap that is removably attached to the replaceable printer component, wherein the angled protective ramp supports the protective cap a spaced-apart distance from the electronic tag.

16. The method of claim 11, wherein the replaceable printer component comprises one of an ink container, a printhead, a printer cartridge including an ink supply and a printhead, and a toner cartridge.

* * * * *